US006767117B2

(12) United States Patent
De'Armond

(10) Patent No.: US 6,767,117 B2
(45) Date of Patent: Jul. 27, 2004

(54) LIGHTING FIXTURE WITH ENCLOSED WIRING

(75) Inventor: Robert De'Armond, Temecula, CA (US)

(73) Assignee: Minka Lighting, Inc., Corona, CA (US)

( * ) Notice: Subject to any disclaimer, the term of this patent is extended or adjusted under 35 U.S.C. 154(b) by 72 days.

(21) Appl. No.: 10/028,090

(22) Filed: Dec. 21, 2001

(65) Prior Publication Data

US 2003/0117806 A1 Jun. 26, 2003

(51) Int. Cl.[7] ..... F21S 13/02

(52) U.S. Cl. ..... 362/432; 362/404; 362/405; 362/406; 362/407; 362/408; 362/409; 362/147

(58) Field of Search ..... 362/432, 404–409, 362/147, 370; D26/72, 80–92, 142–145, 152, 153, 155

(56) References Cited

U.S. PATENT DOCUMENTS

| | | | | | |
|---|---|---|---|---|---|
| 47,225 | A | * | 4/1865 | Gleason | 175/189 |
| 1,722,622 | A | * | 7/1929 | Bliz | 174/62 |
| 5,442,532 | A | * | 8/1995 | Boulos et al. | 362/276 |
| D434,873 | S | | 12/2000 | Jaspers-Fayer et al. | D26/155 |
| D438,660 | S | * | 3/2001 | De'Armond et al. | D26/72 |
| D440,007 | S | | 4/2001 | Pham | D26/142 |
| D446,331 | S | * | 8/2001 | Phillips | D26/72 |

OTHER PUBLICATIONS

U.S. patent application Ser. No. 29/148,515, De'Armond, filed Sep. 20, 2001.
U.S. patent application Ser. No. 29/148,527, De'Armond, filed Sep. 20, 2001.
U.S. patent application Ser. No. 29/148516, De'Armond, filed Sep. 20, 2001.
U.S. patent application Ser. No. 29/148,517, De'Armond, filed Sep. 20, 2001.
U.S. patent application Ser. No. 29/151,010, De'Armond, filed Nov. 30, 2001.

* cited by examiner

*Primary Examiner*—Sandra O'Shea
*Assistant Examiner*—Mark Tsidulko
(74) *Attorney, Agent, or Firm*—Jenkens & Gilchrist, P.C.

(57) ABSTRACT

A lighting fixture (100) for outdoor use having electric wiring (154) enclosed in a rear support arm (140). The lighting fixture includes an upper support arm (112) and a plurality of downwardly disposed supporting rods (118) connected to the lamp housing (116) and the upper support arm.

2 Claims, 5 Drawing Sheets

LIGHTING FIXTURE WITH ENCLOSED WIRING

RELATED APPLICATIONS

The present application is a continuation-in-part of application Ser. No. 29/148,515, filed Sep. 20, 2001, now U.S. Pat. No. D465,603, and a continuation-in -part of application Ser. No. 29/148,516, filed Sep. 20, 2001, now U.S. Pat. No. D461,929, and a continuation-in-part of application Ser. No. 29/148,517, filed Sep. 20, 2001, now U.S. Pat. No. D461, 588; and a continuation-in-part of application Ser. No. 29/148,527, filed Sep. 20, 2001, now U.S. Pat. No. D461, 274, and a continuation-in-part of application Ser. No. 29/151,010, filed Nov. 30, 2001, now U.S. Pat. No. D465, 598.

BACKGROUND OF PRESENT INVENTION

1. Field of the Invention

The present invention relates to electric lighting fixtures. More particularly it relates to light fixtures with enclosed electric wiring therein.

2. Background of the Invention

Long before the invention of the light bulb, lighting fixtures have been commonly used both indoor and outdoor. They have been used first with gas lighting systems and were later designed for use with electric light bulbs. The main purpose of lighting fixtures is to enclose the light bulbs therein and provide protection to the light bulb from external sources. Another common use of the lighting fixtures in some applications is to divert the direct beam of light so as to provide adequate lighting in a room. Yet another common use of lighting fixtures is to provide protection from external weather conditions and to prevent water or other sorts of harmful influence from contacting the lighting bulbs, light socket, wiring electrical connectors and other components of the lighting system. Still another common use of light fixtures is for decorative purposes internally in a home, externally at the entrance of a house, or in any other location where both light source and decoration is needed. It should be also understood that other uses for lighting fixtures are available and it is up to the user to determine the best use.

Generally, lighting fixtures have different designs and are used in different applications. Some are hung from ceilings and others are hung on walls. Wall hung lighting fixtures are commonly used in many applications both indoor and outdoor. There are many forms and shapes of wall hung lighting fixtures. One form of wall hung lighting fixture 10, as illustrated in FIG. 1 (and disclosed in prior art patent D440,007) includes a lamp housing 16 attached at top to support arm 14 that is attached to a backplate 12 affixed to a wall. Electrical wiring for such a fixture is encased in the support arm 14 and thereby concealed from view (for aesthetic purposes) and sheltered from the weather for safety and reliability purposes. Such fixtures are typically used in outdoor settings where protection for the electrical wiring from contact with water is critical. Another such an outdoor fixture 20 is illustrated in FIG. 2 (and disclosed in prior art patent D434,873). The lamp housing 26 is supported by and attached at the bottom by support arm 24 that is attached to backplate 22 attached to a wall. Electrical wiring is enclosed in support arm 24 and thereby protected from water. The wiring is concealed from view for aesthetic purposes. Referring now to FIG. 3, therein is disclosed a lighting fixture 30 commonly used in today's indoor applications. The wiring 33 is commonly passed through the support bracket 32 and is threaded down a supporting rod or chain 34 connected to the lamp housing 6. Threading the wire around the chain or rod is normally acceptable in indoor applications, however, the Underwriters Laboratories (UL) specifies that for outdoor use where the wiring may be exposed to water that externally threading the wiring is not acceptable.

In view of the foregoing, an outdoor lighting fixture that is aesthetically pleasing and in accordance with the UL safety requirement is needed. The lighting fixture of the present invention is aesthetically pleasing, wherein the lamp housing appears to be supported by an upper support and hanging rods and the electric wiring is concealed in a rear support arm.

SUMMARY OF THE INVENTION

The present invention is directed to a lighting fixture having a lamp housing that appears to be suspended from an upper support arm wherein the electrical wiring is enclosed in a rear support arm. The lighting fixture includes an upper support arm and a plurality of downwardly disposed hanging rods attached at the proximal end to the support arm and at their distal end to the lamp housing. The fixture further includes a rear support arm connected to a backplate for mounting on a wall wherein the electric wiring from the lamp backplate to the lamp housing is enclosed in the rear support arm.

BRIEF DESCRIPTION OF THE DRAWINGS

A more complete understanding of the present invention and the scope thereof may be obtained from the accompanying drawings which are briefly summarized below and the Detailed Description when taken in conjunction with the accompanying Drawings wherein.

DETAILED DESCRIPTION OF EXEMPLARY EMBODIMENTS

The present invention will now be described more fully hereinafter with reference to the accompanying drawings in which a preferred embodiment of the invention is shown. This invention may, however, be embodied in many different forms and should not be construed as being limited to the embodiment set forth herein. Rather, the embodiment is provided so that this disclosure will be definite and enabling, and will fully convey the scope of the invention to those skilled in the art.

Figure 2:
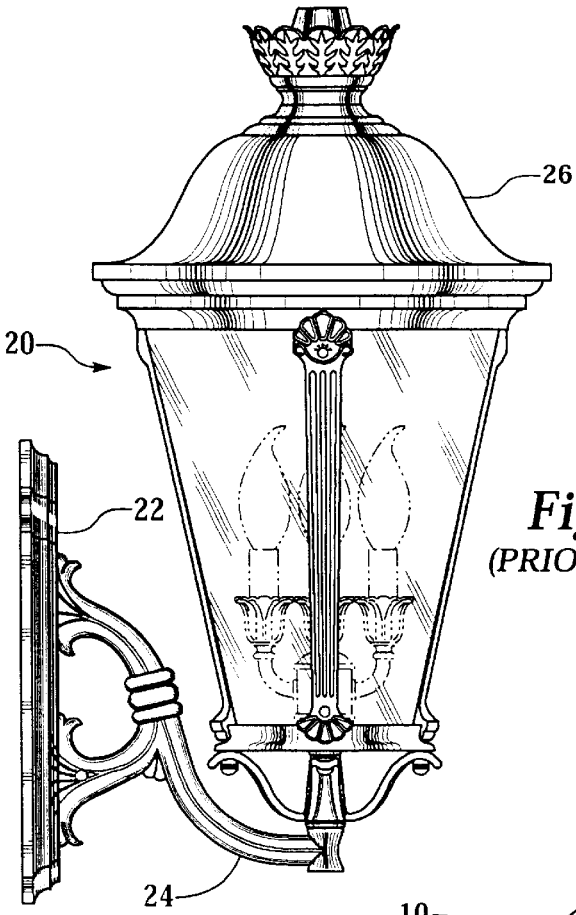
Fig.2 (PRIOR ART)
FIG. 2 illustrates a prior art lighting fixture with a lamp housing supported by a lower support arm having the electrical wiring enclosed in the lower support arm.
Figure 1:
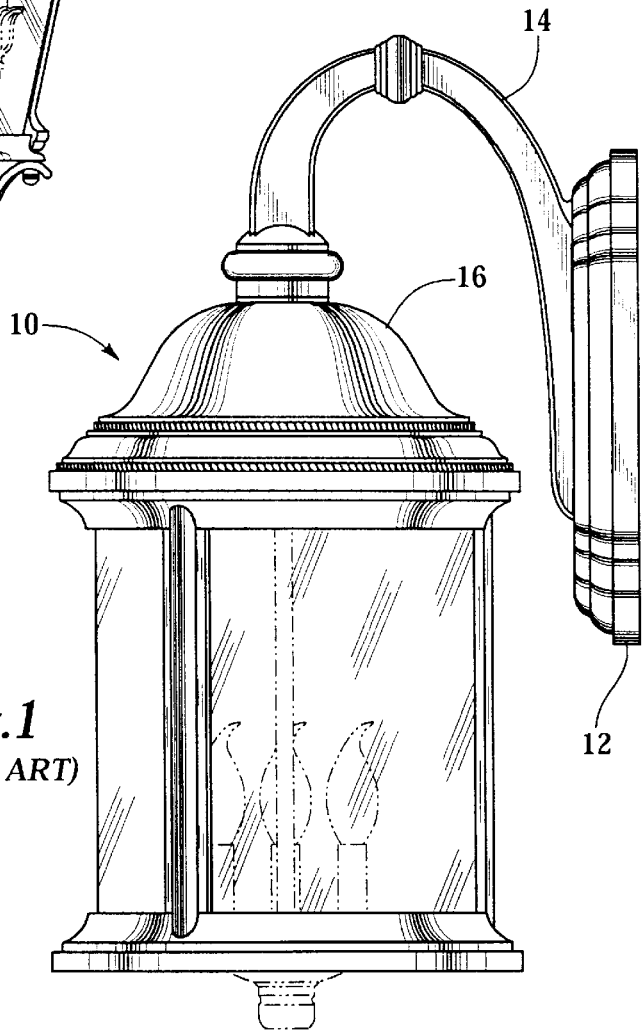
Fig.1 (PRIOR ART)
FIG. 1 illustrates a prior art lighting fixture with a lamp housing, supported by an upper support arm having the electric writing for the fixture enclosed in the upper support arm.
Figure 3:
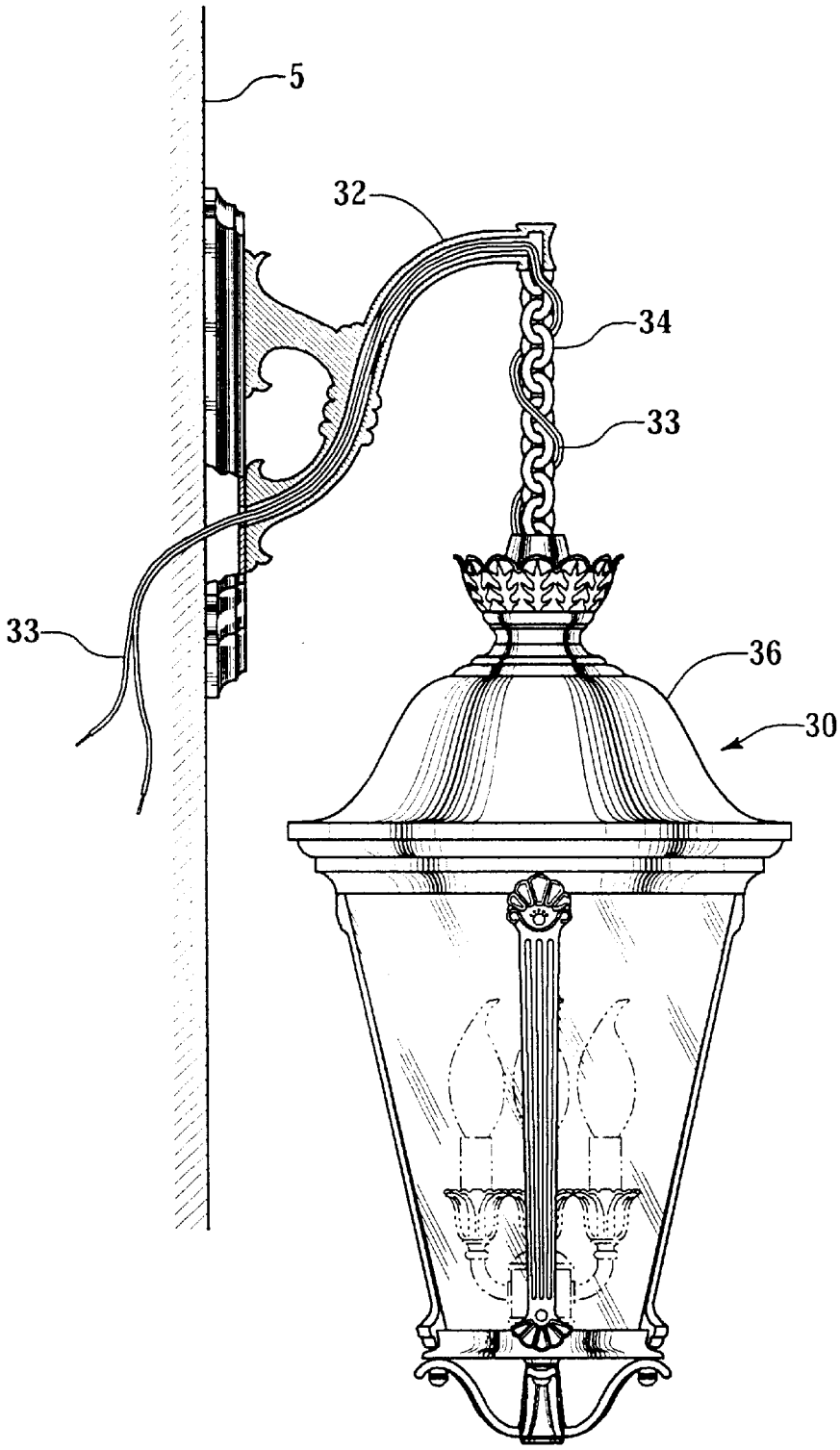
Fig.3 (PRIOR ART)
FIG. 3 illustrates a prior art lighting fixture with a lamp housing suspended from an upper support arm by a chain wherein the electric wiring is exposed and is laced through the chain between the support arm and the lamp housing.

FIGS. 1, 2, and 3 are prior art fixtures as previously discussed and described in the Background section of this application.

Figure 4:
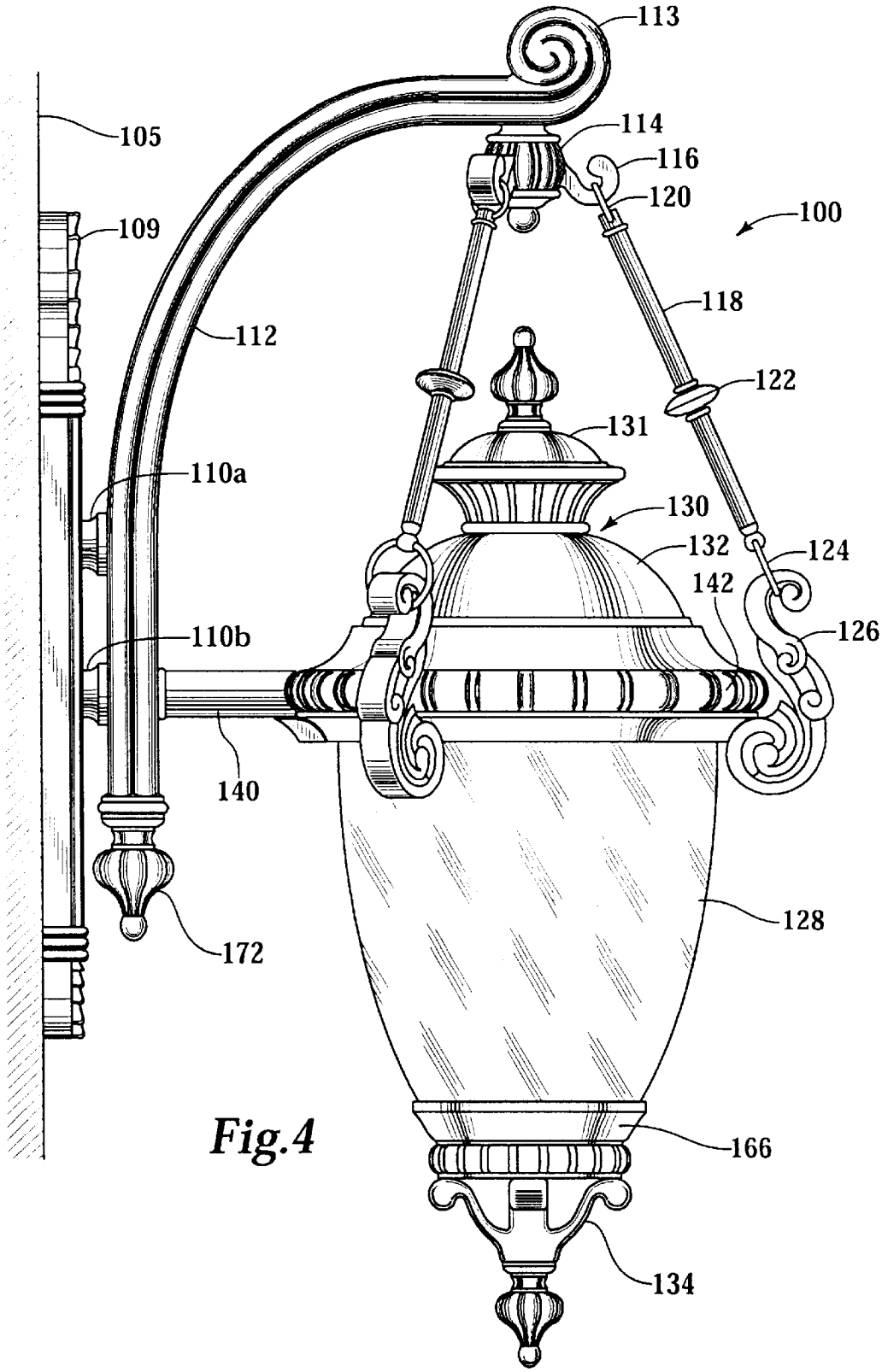
FIG. 4 illustrates a side view of a lighting fixture of the present invention wherein the electric wiring is enclosed in a rear support arm.
Figure 5:
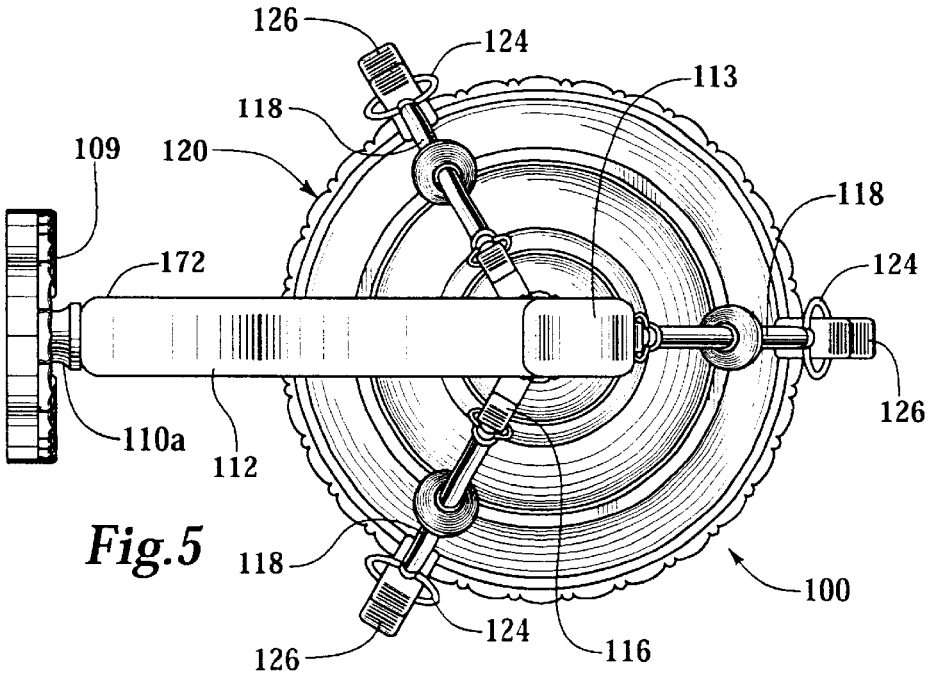
FIG. 5 illustrates a top view of the lighting fixture of FIG. 4.
Figure 6:
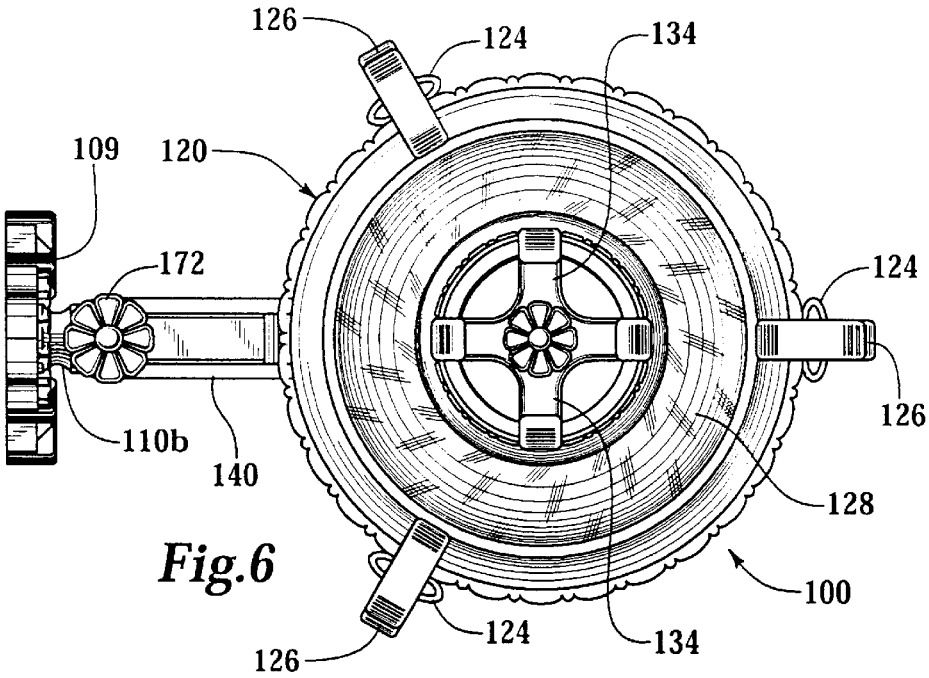
FIG. 6 illustrates a bottom view of the lighting fixture of FIG. 4.

FIGS. 4, 5, and 6 illustrate a side view, a top view and a bottom view of an exemplary embodiment of the lighting fixture 100 of the present invention. A lamp housing 130 is connected to a curved upper support arm 112 securely fixed to a backplate 109 using one or more connecting mechanisms 110*a* and 110*b*. The connecting mechanisms 110*a* and 110*b* may be part of the upper support arm 112. It will be understood by those skilled in the art that upper support arm 112 may be attached directly to backplate 109 by any conventional means such as screws, bolts, welding, etc., with or without connector 110*a* and 110*b*. It should be understood that the connecting mechanisms 110*a* and 110*b* may include one or more connectors. Upper support arm 112 is connected via a plurality of hanging rods 118 to the lamp housing 130. The end of the upper support arm 112 may have various shapes or ornamentation 113 in order to provide a decorative look. The lower end of the upper support arm 112 may also have a decorative finial 172. It should be understood that the upper support arm 112 does not have to be curved and may be of any shape and/or structure. Backplate 109 is secured to wall 105 by any manner known in the art.

The upper support arm 112 at its distal end includes treble hanger 114 which includes a plurality of hooks 116. It should be understood that the hanger 114 may be any type of holder that includes hooks or attachment means for attaching hanging rods 118 to the hanger 114. The number of hooks 116 is preferably equal to the number of hanging rods 118. It should be understood that it is preferably desirable to have three hanging rods 118 as shown in FIGS. 4 and 5. These three hanging rods 118 may be evenly disposed around the circumference of the lamp housing 130. The hanging rods 118 may have a decorative member 122. Each one of the hanging rods 118 includes a connector ring 120 at the upper end and a connector ring 124 at the lower end. The first ring 20 is connected to one of the plurality of hooks 116 while the second ring 124 is connected to a decorative hook shaped holder 126 disposed on the lamp housing 130. It will be understood by those skilled in the art that chains, cables, ropes or other materials may be used instead of hanging rods 118 to connect lamp housing 130 to upper support arm 112.

The lamp housing 130 includes globe 128 preferably made of transparent material or at least a semi-transparent material that will allow light to pass therethrough. The fixture may include a decoration 142 around the upper portion of lamp housing 130. A decorative crown 131 may be included on the top of lamp housing 130. A decorative member 134 may be disposed on the bottom of lamp housing 130.

In a preferred embodiment of the present invention, a rear support arm 140 connects the lighting fixture to the backplate 109. The rear support arm 140 also encloses therein the wiring for the lighting fixture as will be explained in detail hereinafter. The rear support arm 140 is located at the rear of the lighting fixture and is thus concealed from direct view. Thus, a viewer standing in a position directly in front of the lighting fixture or even at an angled view will not be able to see the rear support arm 140. This provides the desirable illusion that the lamp housing 130 is suspended from the upper support arm 112 and hanging rods 118.

The lighting fixture components may be of any adequate material that is appropriate for outdoor exposure including but not limited to aluminum, copper, brass, bronze, nickel, or a ferric material that has been coated or plated for rust prevention.

Figure 7:
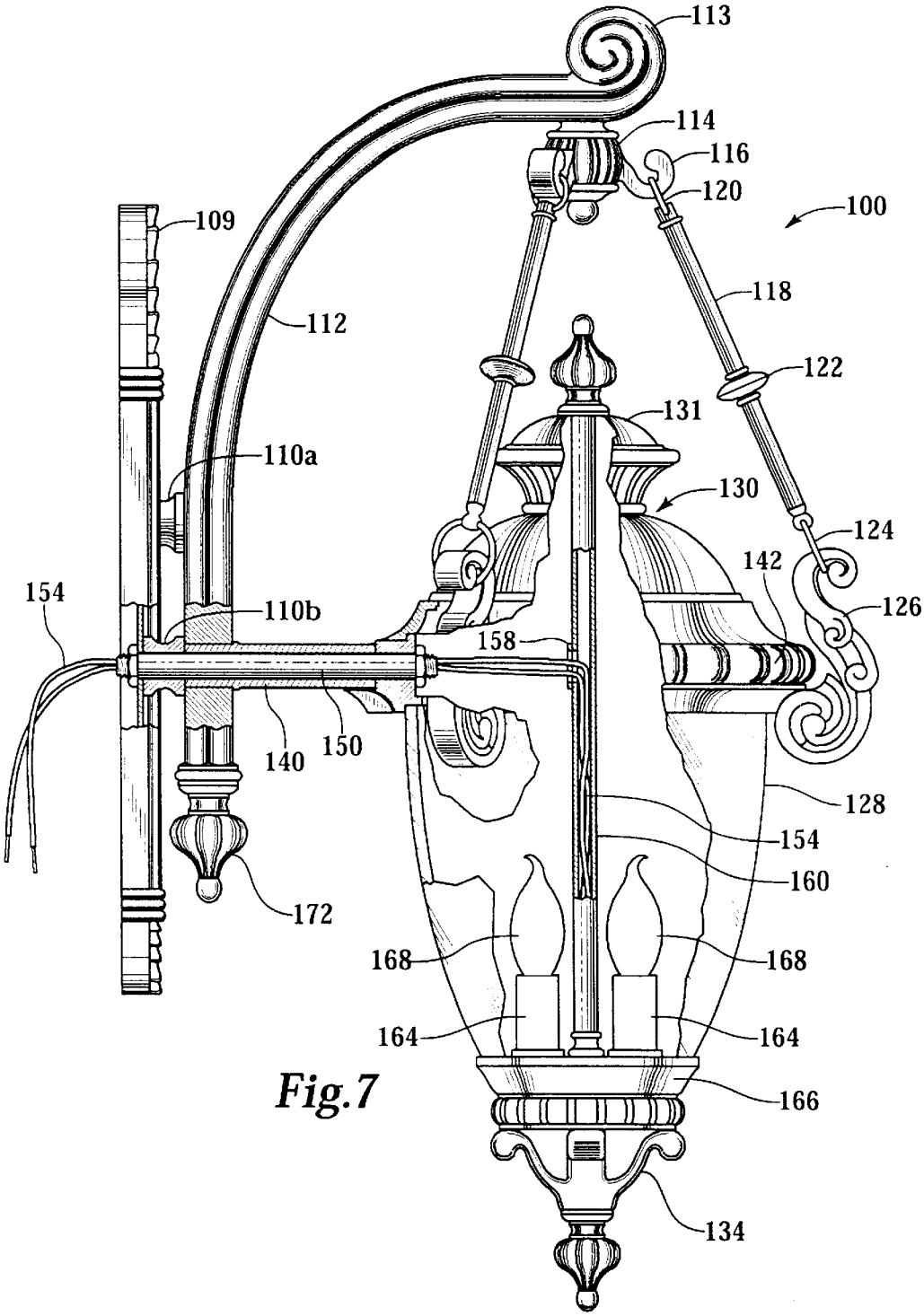
FIG. 7 illustrates a partial cross-section of a side view of the lighting fixture of FIG. 4.

Referring now to FIG. 7, there is shown an exemplary embodiment of the lighting fixture of the present invention illustrated in a cross-sectional side view showing the components therein. The lighting fixture 100, as described hereinabove, is vertically hung from upper support arm 112 using a plurality of supporting rods 118. It will be understood by those skilled in the art that all, a portion of, or none of the weight of lamp housing 130 may actually be carried by upper support arm 112. Likewise, all, a portion of, or none of the weight of lamp housing 130 may be carried by rear support arm 140.

The lamp housing 130 includes therein a tube 160 fixed in place at the top by the crown 131 and at the bottom to the base 166 of the lamp housing 130. The tube 160 is hollow to allow electric wiring 154 to pass therein. The tube 160 has an opening 158 preferably at a position adjacent to the level of the rear support arm 140 as to allow the electric wiring 154 passing therein to be extended through a connector tube 150 disposed inside the rear supporting bracket 140. In the preferred embodiment, electric wiring 154 will terminate at a first end in a conventional junction box where it will be connected to a source of electric current.

The electric wiring 154 is connected at a second end to the lamp socket 164 fixed to the base 166 of the lamp housing 130. It will be understood that one or more candle style electric sockets and bulbs may be used or standard sockets for standard light bulbs may be used for the source of illumination. Alternatively, any type of electric receptacle and electric light source may be used for the source of illumination. The rear support arm 140 is connected to backplate 109 and lamp housing 130 by any means known in the art such as friction fit, welding, brazing, or threaded connectors. The wire 154 after passing through the rear support arm 140 and a conventional junction box may be connected to a switch (not shown) to turn on/off the power supply. When the switch is in the "on" position, electricity passes through the wire 154 to the lamp socket(s) 164 which in turn lights the lamp(s) 168.

In an alternate exemplary embodiment, the connector tube 150 may be formed as an integral part of the rear support arm 140. In such an embodiment, the rear support arm 140 may be hollow or include a tubular opening formed or bored therethrough.

Although a preferred embodiment of the present invention has been illustrated in the accompanying Drawings and described in the foregoing Detailed Description, it will be understood that the invention is not limited to the embodiment disclosed, but is capable of numerous rearrangements, modifications and substitutions without departing from the spirit of the invention as set forth and defined by the following claims.

I claim:

1. An electric lighting fixture comprising:

a backplate for mounting the electric lighting fixture to a wall;

an upper support arm having a proximal end attached to the backplate and a distal end;

a lamp housing having an interior and a translucent globe portion defining the interior;

one or more hanging rods attached at an upper end to the distal end of the upper support arm and attached at a lower end to the lamp housing;

one or more electric receptacles for insertion of an electric light source, said one or more receptacles disposed in the lamp housing;

a rear support arm having a proximal end attached to the backplate and a distal end attached to the lamp housing above the one or more electric receptacles;

an internal passage in the rear support arm, said passage connecting the backplate and the interior of the lamp housing;

electric wiring having at least a portion thereof enclosed in the internal passage of the rear support arm and a portion extending downward in the interior of the lamp toward the one ore more electric receptacles; and a tube in the interior of the lamp housing, wherein at least a portion of the portion of wiring extending downward in the interior of the lamp housing runs through the tube.

2. A lighting fixture comprising:

a backplate for mounting the lighting fixture to a wall;

an upper support arm having a proximal end attached to the backplate;

a lamp housing having an interior and a translucent globe portion defining the interior;

one or more hangers selected from the group consisting of chains, cables, and ropes, said hangers attached at an upper end to a distal end of the upper support arm and said hangers attached at a lower end to the lamp housing;

one or more electric receptacles for receiving an electric light source, said one or more receptacles disposed in the lamp housing;

a rear support arm having a proximal end attached to the backplate and a distal end attached to the lamp housing above the one or more receptacles;

an internal passage in the rear support arm, said passage connecting the backplate and the interior of the lamp housing;

electric wiring having a portion of the electric wiring passing through the internal passage in the rear support arm and a portion extending downward in the interior of the lamp housing toward the one or more electric receptacles; and a tube in the interior of the lamp housing, wherein at least a portion of the portion of wiring extending downward in the interior of the lamp housing runs through the tube.

* * * * *